US010235962B2

(12) United States Patent
Choi et al.

(10) Patent No.: US 10,235,962 B2
(45) Date of Patent: Mar. 19, 2019

(54) TECHNIQUES FOR ROBUST RELIABILITY OPERATION OF A THIN-FILM TRANSISTOR (TFT) DISPLAY

(71) Applicant: Microsoft Technology Licensing, LLC, Redmond, WA (US)

(72) Inventors: Minhyuk Choi, Sammamish, WA (US); Ying Zheng, Sammamish, WA (US); Matthew Morris, Seattle, WA (US); Andrew Cady, Kirkland, WA (US); Jerry Michael Hill, Redmond, WA (US); Gangok Lee, Bothell, WA (US); Rajesh Dighde, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/389,831

(22) Filed: Dec. 23, 2016

(65) Prior Publication Data

US 2018/0182349 A1 Jun. 28, 2018

(51) Int. Cl.
*G09G 3/36* (2006.01)

(52) U.S. Cl.
CPC ..... *G09G 3/3696* (2013.01); *G09G 3/3677* (2013.01); *G09G 3/3688* (2013.01); *G09G 2300/0809* (2013.01); *G09G 2320/041* (2013.01); *G09G 2320/045* (2013.01); *G09G 2320/048* (2013.01); *G09G 2330/021* (2013.01); *G09G 2330/028* (2013.01)

(58) Field of Classification Search
CPC .. G09G 3/3696; G09G 3/3677; G09G 3/3688; G09G 2300/0809; G09G 2320/043–2320/048; G09G 2320/041; G09G 2320/045; G09G 2330/021; G09G 2330/028
See application file for complete search history.

(56) References Cited

U.S. PATENT DOCUMENTS 6,501,230 B1 12/2002 Feldman
2002/0018056 A1* 2/2002 Ozawa ..... G09G 3/2011 345/204

(Continued)

OTHER PUBLICATIONS

"International Search Report and Written Opinion Issued in PCT Application No. PCT/US2017/066911", dated May 25, 2018, 12 Pages.

*Primary Examiner* — Stephen G Sherman
(74) *Attorney, Agent, or Firm* — Arent Fox LLP

(57) ABSTRACT

The present disclosure provides devices and techniques for dynamically adjusting the bias voltage (V) levels (e.g., low level gate voltage (VGL) and high level gate voltage (VGH)) for display screens made with thin-film transistor (TFT) technology based on a display run time. Thus, as the positive bias temperature stress for the TFTs increases over the course of the display lifetime, features of the present disclosure adjust the bias voltage levels to maintain operation margin (e.g., the ratio between the high level gate voltage (VGH) value and the voltage value which the display can maintain with normal operation). By dynamically adjusting the bias voltage levels, the TFT displays of the present disclosure consume lower power than their conventional counterparts and improve the lifetime of the display itself.

19 Claims, 5 Drawing Sheets

(56) References Cited

U.S. PATENT DOCUMENTS

| | | | | |
|---|---|---|---|---|
| 2003/0071804 | A1* | 4/2003 | Yamazaki | G09G 3/3233 345/204 |
| 2006/0077136 | A1* | 4/2006 | Cok | G09G 3/3216 345/76 |
| 2008/0224966 | A1* | 9/2008 | Cok | G09G 3/32 345/82 |
| 2008/0309609 | A1 | 12/2008 | Feng | |
| 2008/0315788 | A1 | 12/2008 | Levey et al. | |
| 2009/0201231 | A1 | 8/2009 | Takahara et al. | |
| 2009/0243987 | A1 | 10/2009 | Chang et al. | |
| 2010/0134482 | A1 | 6/2010 | Ogura et al. | |
| 2010/0277400 | A1 | 11/2010 | Jeong | |
| 2013/0249885 | A1 | 9/2013 | Peng | |
| 2014/0168186 | A1 | 6/2014 | Kang et al. | |
| 2015/0170571 | A1* | 6/2015 | Park | G09G 3/3258 345/690 |
| 2015/0333620 | A1 | 11/2015 | Xi et al. | |
| 2016/0275872 | A1 | 9/2016 | Chaji et al. | |
| 2017/0076683 | A1* | 3/2017 | Lee | G11C 19/28 |

* cited by examiner

300

TECHNIQUES FOR ROBUST RELIABILITY OPERATION OF A THIN-FILM TRANSISTOR (TFT) DISPLAY

BACKGROUND

Flat-panel displays are becoming increasingly commonplace in today's commercial electronic devices. The flat-panel displays are finding widespread use in many new products, such as cellular phones, personal digital assistants (PDAs), camcorders, and laptop personal computers (PCs). The current generation of handheld electronics places stringent demands on their displays. The flat-panel displays in these devices are expected to be lightweight, portable, rugged, low-power and high-resolution.

One example of a flat-panel display is a display screen made with thin-film transistor (TFT) technology. TFTs, common in notebook and laptop computers, generally have a transistor for each pixel on the screen. A display is generally composed of a grid (or matrix) of picture elements ("pixels"). The collection of pixels creates an image on the display. TFTs in a display act as switches to individually turn each pixel "on" (light) or "off" (dark). The TFTs are the active elements, arranged in a matrix, on the display. Having a transistor at each pixel means that the current that triggers pixel illumination can be smaller and therefore can be switched on and off more quickly. Thus, the TFT display technology is more responsive to any changes. For example, when a user moves a mouse across the screen, a TFT display rapidly reflects the movement of the mouse cursor as compared to conventional displays.

TFT displays, however, are more susceptible to degradation over time. Particularly, a threshold voltage ($V_T$) of a TFT tends to shift under bias stress ($V_T$-shift). Consequently, the TFT display uniformity degrades over time due to differential aging of the TFTs employed in the pixel circuits. In order to compensate for this degradation, display manufacturers generally preset voltage values used to drive the TFTs in the TFT display at a high level that ensures optimal operability of the display over the lifetime of the display. However, setting high voltage values of the TFTs at the onset results in greater power consumption than is necessary during the early periods of the display lifetime. Additionally, presetting to high voltage values may deteriorate the operational lifetime of the display more quickly than displays utilizing low voltage values.

SUMMARY

In contrast to the conventional methods that rely on a preset voltage configuration of the TFT display, the techniques described herein dynamically adjust the bias voltage (V) levels (e.g., low level gate voltage (VGL) value and high level gate voltage (VGH) value) for the TFT based on a display run time (e.g., number of hours that each display is operational). In some examples, the adjustments may further be based on the temperature stress for the TFT display. Thus, as the positive bias temperature stress for the TFTs increases over the course of the display lifetime, features of the present disclosure adjust the bias voltage levels to maintain operation margin (e.g., the ratio between the VGH and a reference voltage ($V_{clamp}$) that represents a maximum amount of voltage that can pass through an electrical component before it restricts further voltage from passing to a device or computer). Over the course of a display's operational lifetime, the $V_{clamp}$ value may gradually increase. Thus, by dynamically adjusting the bias voltage levels, the TFT displays of the present disclosure consume lower power than their conventional counterparts and improve the lifetime of the display itself.

In one example, a method for controlling voltage consumption of a TFT display is disclosed. The method may include setting a voltage level for the TFT display during a first time period to a first voltage value. The method may further include determining a display run time of the TFT display during a second time period and adjusting the voltage level from the first voltage value to a second voltage value based on the determining.

In another example, an apparatus for controlling voltage consumption of a TFT display is disclosed. The apparatus may include a processor and a memory coupled to the processor. The memory may include instructions executable by the processor to set a voltage level for the TFT display during a first time period to a first voltage value and determine a display run time of the display during a second time period. The instructions may be further executable by the processor to adjust the voltage level from the first voltage value to a second voltage value based on the determining.

In another example, a computer readable medium for controlling voltage consumption of a TFT display is disclosed. The computer readable medium may include instructions for setting a voltage level for the TFT display during a first time period to a first voltage value. The instructions may further include determining a display run time of the TFT display during a second time period and adjusting the voltage level from the first voltage value to a second voltage value based on the determining.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein, both their organization and method of operation, together with associated advantages will be better understood from the following description when considered in connection with the accompanying figures. Each of the figures is provided for the purpose of illustration and description only, and not as a definition of the limits of the claims.

DETAILED DESCRIPTION

Figure 1:
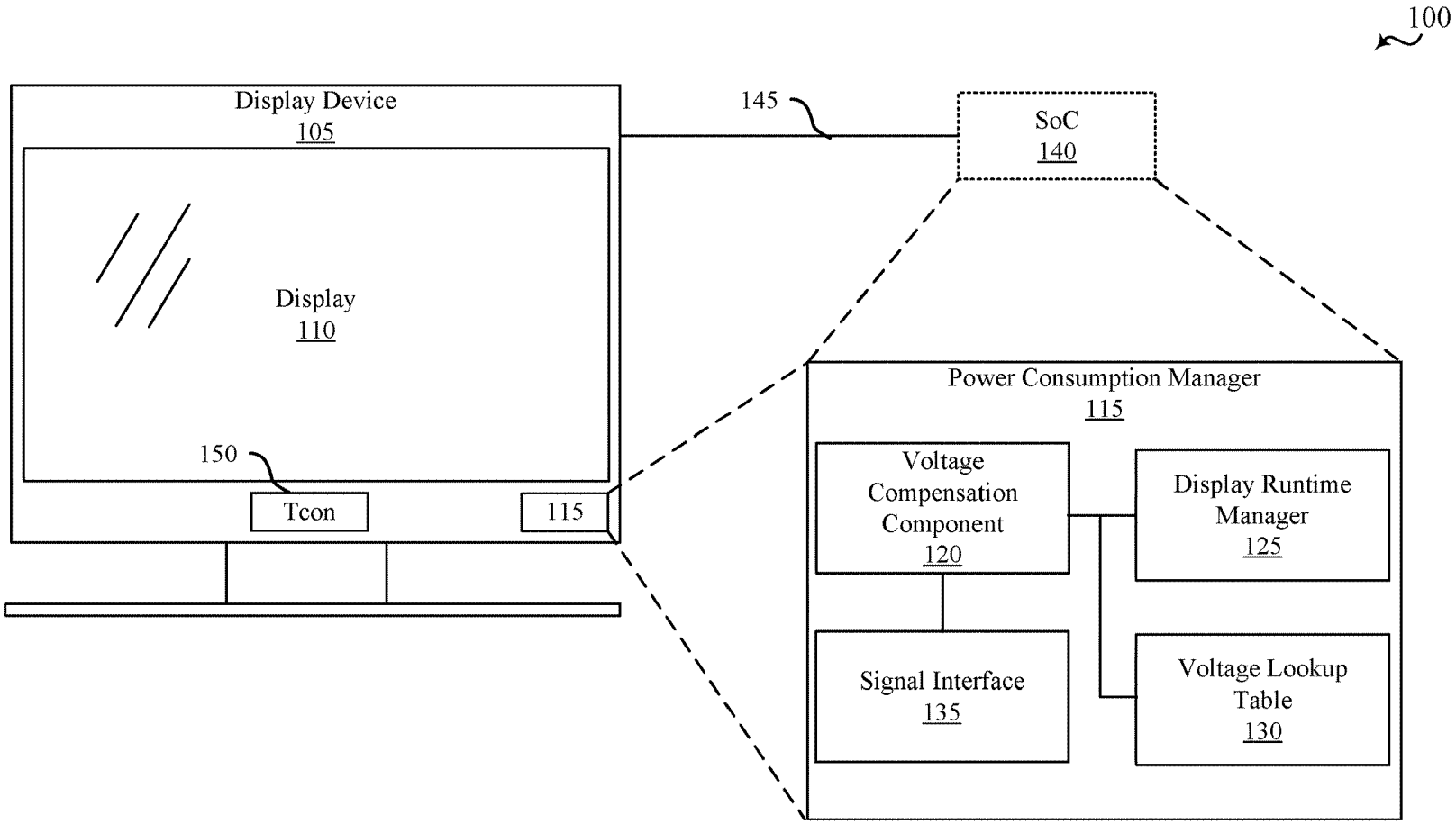
FIG. 1 is a schematic diagram of an example of a display device in which features of the present disclosure may operate.

As discussed above, TFT displays are susceptible to degradation over time. Particularly, a threshold voltage ($V_T$)

of a TFT tends to shift under bias stress ($V_T$-shift) causing the TFT display uniformity to degrade over time due to differential aging of the TFTs employed in the pixel circuits. In addition, TFTs may be sensitive to temperature variations that can cause localized image ghosting, thermal run-away, and high power consumption. In order to compensate for degradation in conventional TFT displays, display manufacturers generally preset voltage values of the TFT display at a level that ensures operability of the display over the lifetime of the display. However, setting a high voltage value of the TFTs at the onset results in greater power consumption than is necessary during the early periods of the display lifetime.

In contrast, the techniques described herein dynamically adjust the bias voltage levels (e.g., VGL and VGH) for the TFT based on a display run time (e.g., number of hours that each display is operational). Thus, as the positive bias temperature stress for the TFTs increases over the course of the display lifetime, features of the present disclosure adjust the bias voltage levels to maintain operation margin (e.g., the ratio between the VGH and the reference voltage value which the display can maintain with normal operation). By dynamically adjusting the bias voltage levels, the TFT displays of the present disclosure consume lower power than their conventional counterparts and improve the lifetime of the display itself. Thus, in some examples, the adjustments to the voltage levels may be calculated based on prior testing that determines how the stress level affects the performance of the device over time. To compensate for the deterioration in performance, features of the present disclosure adjust the voltage values as the display ages.

Various aspects are now described in more detail with reference to the FIGS. 1-4. In the following description, for purposes of explanation, numerous specific details are set forth in order to provide a thorough understanding of one or more aspects. It may be evident, however, that such aspect(s) may be practiced without these specific details. Additionally, the term "component" as used herein may be one of the parts that make up a system, may be hardware, firmware, and/or software stored on a computer-readable medium, and may be divided into other components.

The following description provides examples, and is not limiting of the scope, applicability, or examples set forth in the claims. Changes may be made in the function and arrangement of elements discussed without departing from the scope of the disclosure. Various examples may omit, substitute, or add various procedures or components as appropriate. For instance, the methods described may be performed in an order different from that described, and various steps may be added, omitted, or combined. Also, features described with respect to some examples may be combined in other examples Turning first to FIG. 1, a display device architecture 100 includes a TFT display device 105 that has display screen 110 integrated thereto. The TFT display 105 may include at least one TFT with an oxide active layer or a TFT with a poly-silicon active layer. In some examples, the display screen 110 may be referred to as the liquid crystal panel of the display device 105. In some examples, each pixel region of the display screen 110 may include one or more of a TFT, a pixel electrode, a common electrode, and a storage capacitor. The TFT may include a gate electrode connected to the corresponding scanning line for receiving scanning signals therefrom. The display device 105 may also include a power consumption manager 115 to adjust the voltage levels of the display device 105. In some examples, the power consumption manager 115 may be implemented separate from the timing controller (TCON) 150. In other examples, at least a portion of the power consumption manager 115 may be implemented with the TCON 150. Thus, in some aspects, one or more of the features of the power consumption manager 115 may be performed by the TCON 150. It should also be appreciated that the power consumption manager 115 may be implemented either as part of the display device 105 or in a separate system on a chip 140 (SoC) that is coupled to the display device 105 (e.g., via electrical connection 145).

In some aspects, the display device 105 may incorporate a voltage switch that can be controlled by a logic signal (e.g., from signal interface 135) from the TCON to provide the gate-voltage modulation for VGH and/or VGL. The logic signals may be based on the voltage value section performed by the voltage compensation component 120. Thus, as the voltage level values (e.g., first voltage value, second voltage value) are adjusted (increased or decreased) by the voltage compensation component 120, the signal interface 135 generates one or more logic signals that affect the voltage requirements of the display device 105.

In some examples, the display device 105 may be referred to interchangeably as either "TFT Display Device" or "active matrix display device". The liquid crystal panel 110 includes a data driver for driving signal lines at a liquid crystal panel 110, and a gate driver for driving gate lines at a liquid crystal panel 110. In the liquid crystal panel 110, pixels connected to signal lines and gate lines are arranged in an active matrix pattern. Each pixel includes a liquid crystal cell for responding to a data voltage signal (DVS) from the signal line to control a transmitted light quantity. The liquid crystal panel 110 may also include a TFT for responding to a scanning signal from the gate line to switch the data voltage signal DVS to be applied from the signal line to the liquid crystal cell. As the gate lines are sequentially driven, the data driver applies the data voltage signal DVS to all the signal lines. The gate driver allows the gate lines to be sequentially enabled for each horizontal synchronous interval by applying the scanning signal to the gate lines. In some examples, a control switch may selectively deliver any one of the VGL and VGH to the gate lines. For example, the TFT at the gate line supplied with the high level gate voltage VGH is turned on and thus the liquid crystal cell charges the data voltage signal DVS.

Features of the present disclosure provide techniques for adjusting the one or more of VGH and/or VGL based on the display run time of each liquid crystal panel 110. As the display run time (e.g., time that the liquid crystal panel 110 is on and in use during the display device 105 lifetime), the voltage compensation component 120 adjusts the VGH and VGL to account for any degradation that the liquid crystal panel 110 may experience over the course of its operational lifetime. In one example, the adjusted voltage values may be calculated or retrieved from the voltage lookup table 130 that correlates the current display run time with the voltage level values in the lookup table database. In some examples, the voltage levels may be set based on a predetermined range of the display run time. For instance, as a non-limiting example, the voltage compensation component 120 may set the first voltage value for display run time of 0-100 hours and a second voltage value for display run time of 101-200 hours, and a third voltage value for display run time of 201-300 hours, etc. While the example above specifies modifying at specified ranges, it should be appreciated that the voltage level adjustments may be implemented at non-uniform time periods. For example, the voltage values may be regularly adjusted as the display device 105 ages. Thus, as the cumulative display run time increases, the voltage compensation component 120 may access the voltage lookup table 130 to identify the voltage values for one or more of the VGH and VGL that should be adjusted to in order to compensate for any degradation that may be experienced at the liquid crystal panel 110. Accordingly, as the display run time manager 125 determines that the display run time hours has exceeded a first threshold (e.g., first range of 101-200 hours), the display run time manager 125 may issue a trigger to the voltage compensation component 120 to adjust the voltage levels of the display device 105.

Figure 2A:
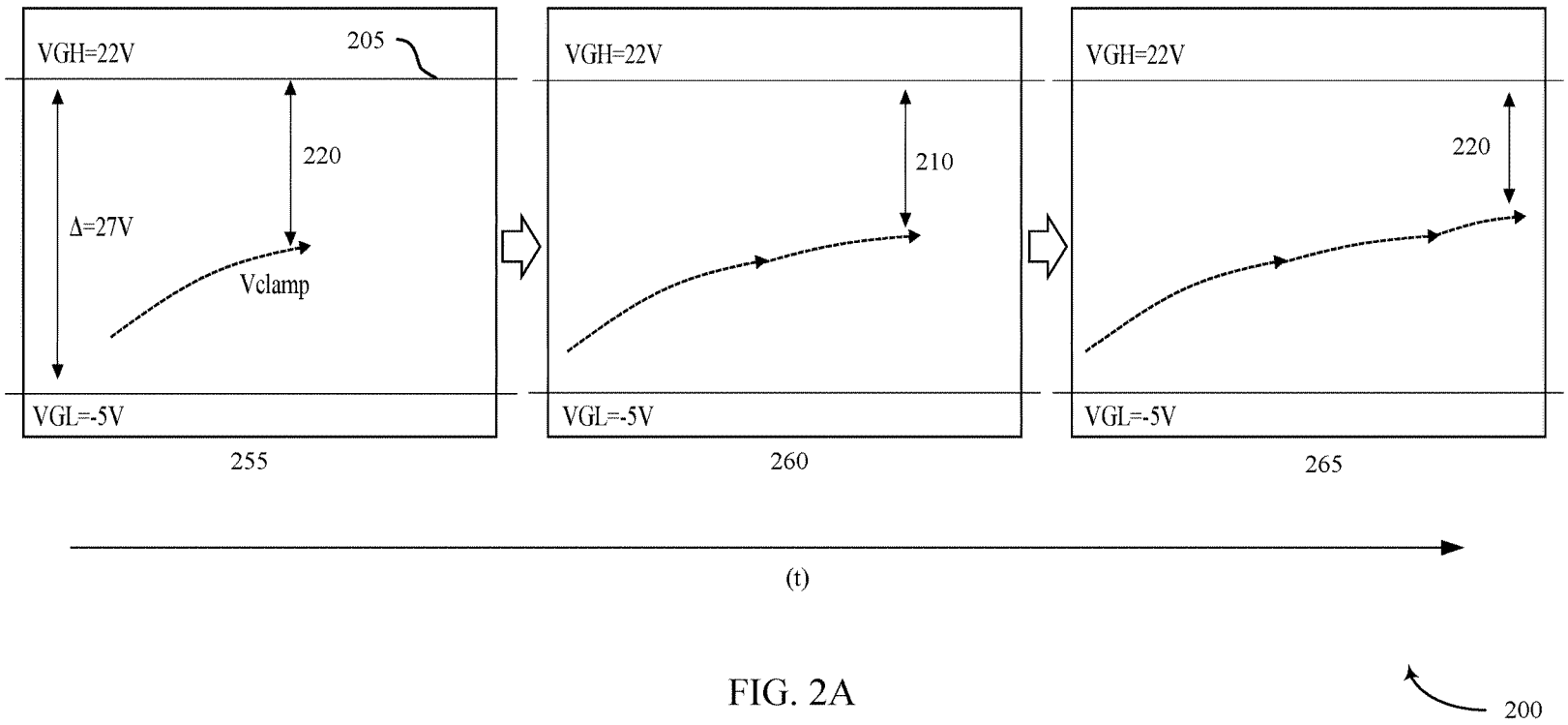
FIG. 2A (Related Art)
FIG. 2A is an example of a related art display device that presets the voltages of the display at the time of manufacturing.

FIG. 2A illustrates one example of a solution 200 that relies on setting the voltage levels (e.g., VGH and VGL) to predetermined values during the display device production. In the illustrated example, the voltage levels are set to maximum voltage levels (e.g., VGH=22V and VGL=−5V) from the onset of the display device production in order to maintain the operation margin 220 at the end of the display device lifetime (e.g., during a third time period 265). However, in doing so, the display device 105 consumes greater power during the earlier time periods of the display device lifetime (e.g., first time period 255 and the second time period 260). The higher voltage levels may not only account for mismanagement of the power consumption, but may also adversely reduce the effective lifetime of the display device 105.

Figure 2B:
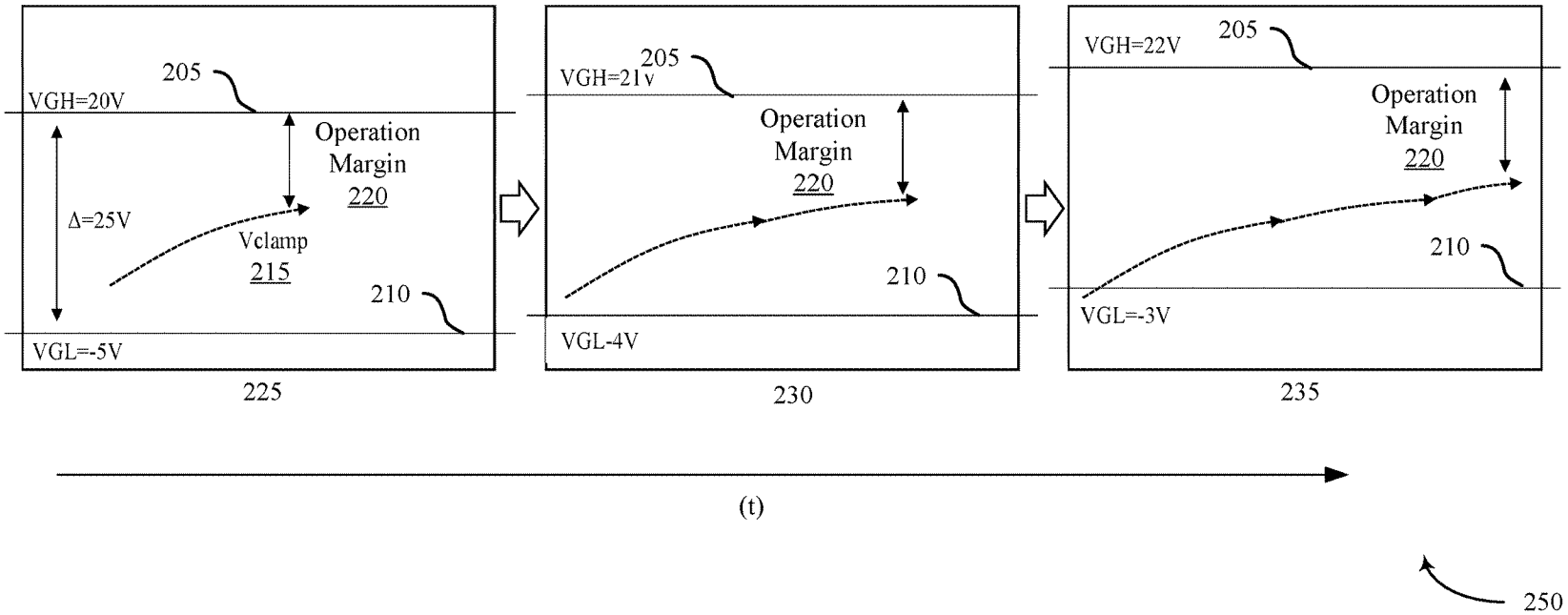
FIG. 2B is an example of a display device voltage adjustments based on the display run time in accordance with aspects of the present disclosure.

In contrast, FIG. 2B is a timing diagram 250 of display device voltage adjustments based on the display run time in accordance with aspects of the present disclosure. The diagram 250 illustrates the voltage levels (e.g., VGH 205 and VGL 210) for the display device 105 as a matter of time. Thus, during a first time period 225, the features of the present disclosure set the voltage levels at a first voltage value (e.g., VGH=20V and VGL=−5V). The first voltage levels are selected in order to maintain sufficient operation margin 220 between $V_{clamp}$ 215 of the display device 105 and the VGH. The term "$V_{clamp}$" may refer to reference voltage that represents the desired clamp point which is a maximum amount of voltage that can pass a surge protector or electrical breaker before it restricts further voltage from passing to a device or computer. In some examples, it is a process through which a device or equipment is protected from electrical surges. It should be noted that the voltage values identified herein are only for the purposes of providing an example and should not be construed as limiting.

In some examples, the first voltage value(s) may correspond to a first range of display run time (e.g., 0-100 hours) maintained in the database of the display device during the first time period 225. As the operation time of the display device 105 increases, the display run time may transition into a second range of display run time (e.g., 101-200 hours) during a second time period 230. As such, techniques of the present disclosure adjust the voltage levels to a second voltage value (e.g., VGH=21V and/or VGL=−4V) in order to maintain the operation margin 220. Similarly, as the display run time extends to a third time period 235, the features of the present disclosure may further adjust the voltage levels to a third voltage value (e.g., VGH=22V and VGL=−3 V). By implementing the features of the present disclosure, voltage consumption may be managed throughout the lifetime of the display device and the effective operability lifetime of the display device may be extended as compared to conventional systems.

Figure 3:
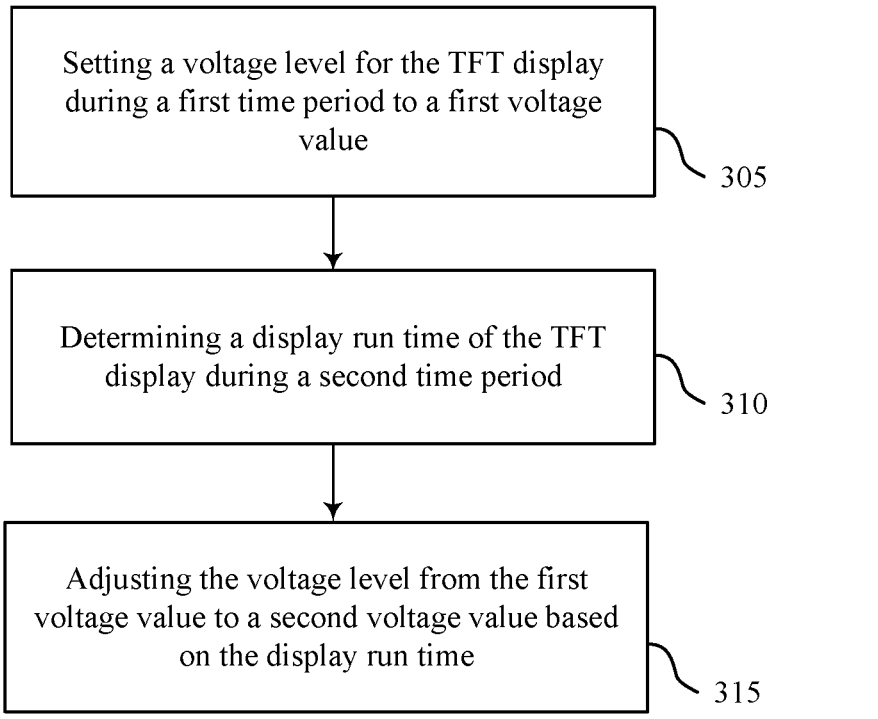
FIG. 3. is a flow chart of a method implemented on the display device in accordance with various aspects of the present disclosure.

Referring to FIG. 3, an example method 300 for controlling voltage consumption of a TFT display is described. The method 300 may be performed by the display device 105 as described with reference to FIGS. 1-2. Additionally or alternatively, the method 300 may be performed by a SoC that is separate from the TFT display. Further, although the method 300 is described below with respect to the elements of the display device 100 or a SoC (not shown), other components (e.g., TCON) may be used to implement one or more of the steps described herein.

At block 305, the method 300 may include setting a voltage level for the TFT display during a first time period to a first voltage value. In some examples, the first voltage value may be a predetermined default value or a value obtained based on the display run time information (e.g., display run time at or near zero (0) or temperature stress measured on the display device). Aspects of block 305 may be performed by power consumption manager 115 described with reference to FIGS. 1 and 4.

At block 310, the method 300 may include determining a display run time of the TFT display during a second time period. In some aspects, the display run time may be determined based on a counter that maintains the numbers of hours that the display is operational (e.g., "in use" and/or turned "on"). Aspects of block 310 may be performed by the display run time manager 125 described with reference to FIGS. 1 and 4.

At block 315, the method 300 may include adjusting the voltage level from the first voltage value to a second voltage value based on the display run time. In some examples, the adjusting may comprise identifying the second voltage value by correlating the display run time of the TFT display with one of the voltage values in a lookup table stored in a memory. The memory may be part of the display device 105 or a separate SoC. In some examples, both the first voltage value and the second voltage value (or any subsequent voltage values) may be determined in order to maintain an operation margin between a reference voltage which the TFT display can maintain with normal operation (i.e., "Vclamp") and the VGH. Particularly, the voltage compensation component 120 maintains the operation margin from the first time period (e.g., display run time range of 0-100 hours) to the second time period (e.g., display run time at 500 hours) by continuously and dynamically adjusting the voltage levels (e.g., VGH and VGL). Thus, the voltage level is adjusted as a positive bias temperature stress for the TFT display increases over the course of the TFT display lifetime. In some examples, the first voltage value (e.g., VGH 20V) is lower than the second voltage value (e.g., VGH 22V). More specifically, the adjustments to the voltage levels may be calculated based on prior testing that determines how the stress level affects the performance of the device over time. To compensate for the deterioration in performance, features of the present disclosure adjust the voltage values as the display ages. Similar adjustments may be made with respect to the VGL (e.g., first voltage value VGL −5V at first time period and second voltage value VGL −3V at the second time period). Aspects of block 315 may be performed by the voltage compensation component 120 described with reference to FIGS. 1 and 4.

Figure 4:
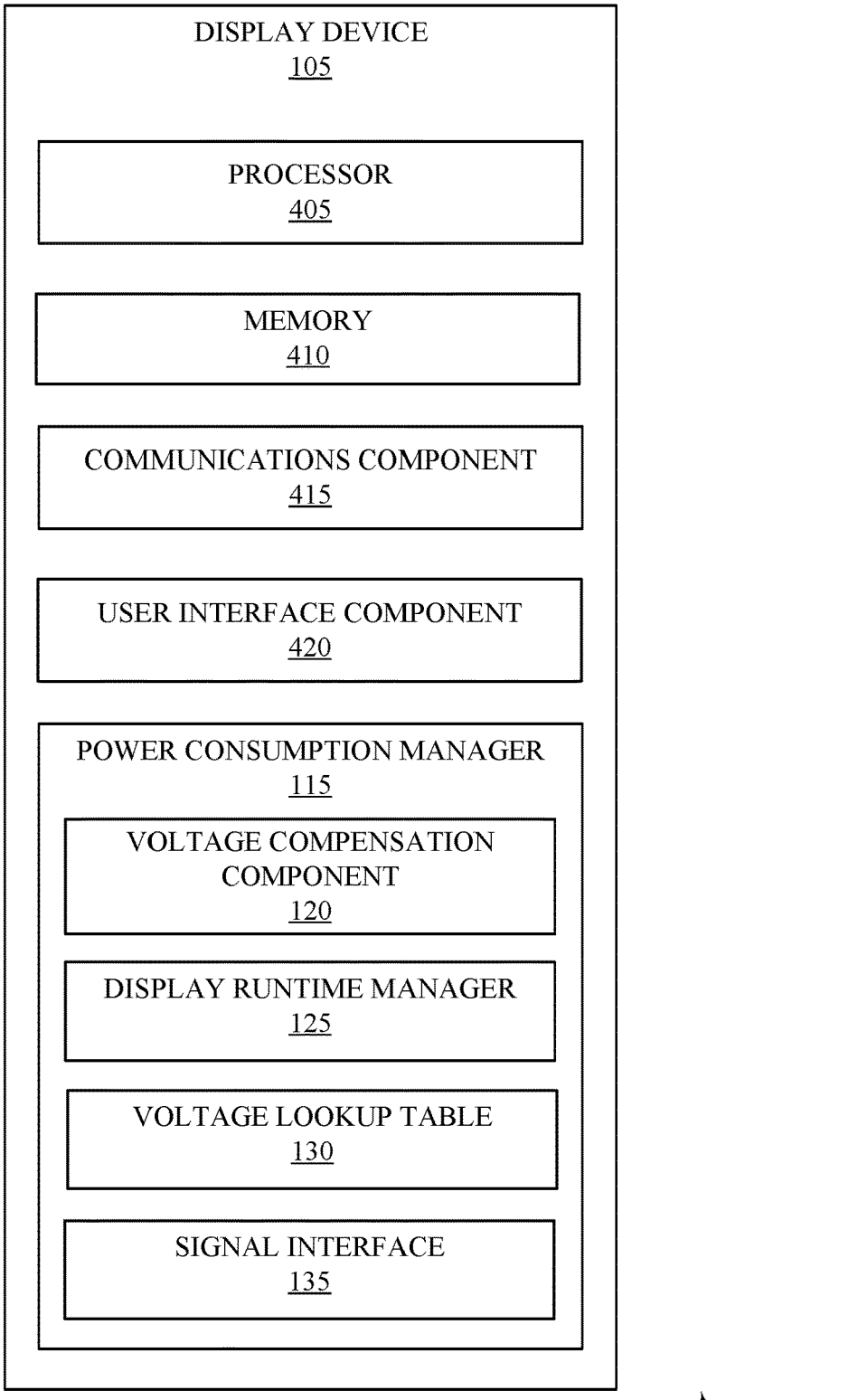
FIG. 4 is a diagram illustrating an example of a hardware implementation for a display device in accordance with various aspects of the present disclosure.

Referring now to FIG. 4, a diagram illustrating an example of a hardware implementation for a display device 105 in accordance with various aspects of the present disclosure is described. In some examples, the display device 105 may include a processor 405 for carrying out one or more processing functions (e.g., method 300) described herein. The processor 405 may include a single or multiple set of processors or multi-core processors. Moreover, the processor 405 can be implemented as an integrated processing system and/or a distributed processing system.

The display device 105 may further include memory 410, such as for storing local versions of applications being executed by the processor 405. In some aspects, the memory 410 may be implemented as a single memory or partitioned memory. In some examples, the operations of the memory 410 may be managed by the processor 405. Memory 410 can include a type of memory usable by a computer, such as random access memory (RAM), read only memory (ROM), tapes, magnetic discs, optical discs, volatile memory, non-volatile memory, and any combination thereof. Additionally, the processor 405, and memory 410 may include and execute operating system (not shown).

Further, display device 105 may include a communications component 415 that provides for establishing and maintaining communications with one or more parties utilizing hardware, software, and services as described herein. Communications component 415 may carry communications between components on display device 105, as well as between display device 105 and external devices, such as to electronic devices coupled locally to the display device 105 and/or located across a communications network and/or devices serially or locally connected to display device 105. For example, communications component 415 may include one or more buses operable for interfacing with external devices.

The display device 105 may also include a user interface component 420 operable to receive inputs from a user of display device 105 and further operable to generate outputs for presentation to the user. User interface component 420 may include one or more input devices, including but not limited to a touch-sensitive display, a navigation key, a function key, a microphone, a voice recognition component, any other mechanism capable of receiving an input from a user, or any combination thereof. Further, user interface component 420 may include one or more output devices, including but not limited to a display, a speaker, any other mechanism capable of presenting an output to a user, or any combination thereof.

The display device 105 may also include power consumption manager 115 for dynamically adjusting the voltage levels (e.g., VGH and/or VGL) based on the display time of the display device 105. In some examples, the adjustments to the voltage levels may be controlled by the voltage compensation component 120 by receiving the display run time input from the display run time manager 125. In some aspects, the display run time manager 125 may maintain a historical record in the memory 410 of the display device 105 that specifies the number of hours the display device 105 has been active and operational. The historical record may represent the time from the display device 105 deployment from the manufacturer to a specified time period (e.g., current time period).

Upon obtaining the display run time information from the display run time manager 125, the voltage compensation component 120 correlates the display run time with a voltage values in a voltage lookup table 130 that would maintain a predetermined operation margin between the reference voltage of the display device 105 and the VGH. As discussed above, the $V_{clamp}$ 215 reference voltage may increase over the course of the display device 105 lifetime. Thus, based on the correlation, the voltage compensation component 120 may identify a voltage value to which the voltage level should be adjusted to that minimizes power consumption of the display device 105, while maximizing its lifetime viability. The selected VGH and/or VGL voltage values are forwarded to the signal interface 135 that modifies the VGH and VGL levels of the display device 105 based on the display run time during the current time period.

As used in this application, the terms "component," "system" and the like are intended to include a computer-related entity, such as but not limited to hardware, firmware, a combination of hardware and software, software, or software in execution. For example, a component may be, but is not limited to being, a process running on a processor, a processor, an object, an executable, a thread of execution, a program, and/or a computer. By way of illustration, both an application running on a computing device and the computing device can be a component. One or more components can reside within a process and/or thread of execution and a component may be localized on one computer and/or distributed between two or more computers. In addition, these components can execute from various computer readable media having various data structures stored thereon. The components may communicate by way of local and/or remote processes such as in accordance with a signal having one or more data packets, such as data from one component interacting with another component in a local system, distributed system, and/or across a network such as the Internet with other systems by way of the signal.

Furthermore, various aspects are described herein in connection with a device (e.g., computer device 100), which can be a wired device or a wireless device. A wireless device may be a cellular telephone, a satellite phone, a cordless telephone, a Session Initiation Protocol (SIP) phone, a wireless local loop (WLL) station, a personal digital assistant (PDA), a handheld device having wireless connection capability, a computing device, or other processing devices connected to a wireless modem. In contract, a wired device may include a server operable in a data centers (e.g., cloud computing).

It is understood that the specific order or hierarchy of blocks in the processes/flow charts disclosed is an illustration of exemplary approaches. Based upon design preferences, it is understood that the specific order or hierarchy of blocks in the processes/flow charts may be rearranged. Further, some blocks may be combined or omitted. The accompanying method claims present elements of the various blocks in a sample order, and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "at least one of A, B, and C," and "A, B, C, or any combination thereof" include any combination of A, B, and/or C, and may include multiples of A, multiples of B, or multiples of C. Specifically, combinations such as "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

It should be appreciated to those of ordinary skill that various aspects or features are presented in terms of systems that may include a number of devices, components, modules, and the like. It is to be understood and appreciated that the various systems may include additional devices, components, modules, etc. and/or may not include all of the devices, components, modules etc. discussed in connection with the figures.

The various illustrative logics, logical blocks, and actions of methods described in connection with the embodiments disclosed herein may be implemented or performed with a specially-programmed one of a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Additionally, at least one processor may comprise one or more components operable to perform one or more of the steps and/or actions described above.

Further, the steps and/or actions of a method or algorithm described in connection with the aspects disclosed herein may be embodied directly in hardware, in a software module executed by a processor, or in a combination of the two. A software module may reside in RAM memory, flash memory, ROM memory, EPROM memory, EEPROM memory, registers, a hard disk, a removable disk, a CD-ROM, or any other form of storage medium known in the art. An exemplary storage medium may be coupled to the processor, such that the processor can read information from, and write information to, the storage medium. In the alternative, the storage medium may be integral to the processor. Further, in some aspects, the processor and the storage medium may reside in an ASIC. Additionally, the ASIC may reside in a user terminal. In the alternative, the processor and the storage medium may reside as discrete components in a user terminal. Additionally, in some aspects, the steps and/or actions of a method or algorithm may reside as one or any combination or set of codes and/or instructions on a machine readable medium and/or computer readable medium, which may be incorporated into a computer program product.

In one or more aspects, the functions described may be implemented in hardware, software, firmware, or any combination thereof. If implemented in software, the functions may be stored or transmitted as one or more instructions or code on a computer-readable medium. Computer-readable media includes both computer storage media and communication media including any medium that facilitates transfer of a computer program from one place to another. A storage medium may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection may be termed a computer-readable medium. For example, if software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave may be included in the definition of medium. Disk and disc, as used herein, includes compact disc (CD), laser disc, optical disc, digital versatile disc (DVD), floppy disk and Blu-ray disc where disks usually reproduce data magnetically, while discs usually reproduce data optically with lasers. Combinations of the above should also be included within the scope of computer-readable media.

While aspects of the present disclosure have been described in connection with examples thereof, it will be understood by those skilled in the art that variations and modifications of the aspects described above may be made without departing from the scope hereof. Other aspects will be apparent to those skilled in the art from a consideration of the specification or from a practice in accordance with aspects disclosed herein.

What is claimed is:

1. A method for controlling voltage bias of a thin-film transistor (TFT) display, comprising:

setting a voltage level for the TFT display during a first time period to a first voltage value;

determining a display run time of the TFT display during a second time period; and dynamically adjusting the voltage level from the first voltage value to a second voltage value based on the display run time and a measured temperature of the TFT display.

2. The method of claim 1, wherein dynamically adjusting the voltage level from the first voltage value to the second voltage value, comprises:

identifying the second voltage value by correlating the display run time of the TFT display with one of the voltage values in a lookup table stored in a memory.

3. The method of claim 1, wherein dynamically adjusting the voltage level from the first voltage value to the second voltage value, comprises:

determining an operation margin between a reference voltage ($V_{clamp}$) and a high level gate voltage (VGH) value; and maintaining the operation margin from the first time period to the second time period by adjusting the voltage level.

4. The method of claim 1, wherein dynamically adjusting the voltage level from the first voltage value to the second voltage value comprises:

adjusting the voltage level in response to an increase of a positive bias temperature stress for the TFT display over the course of the TFT display lifetime.

5. The method of claim 1, wherein the voltage level includes one or more of a low level gate voltage (VGL) value and a high level gate voltage (VGH) value of the TFT display.

6. The method of claim 1, wherein the first voltage value is lower than the second voltage value.

7. The method of claim 1, wherein the TFT display includes at least one TFT with an oxide active layer or a poly-silicon active layer.

8. The method of claim 1, wherein the voltage bias of the TFT display is controlled by a timing controller (TCON) implemented in the TFT display.

9. An apparatus for controlling the voltage bias of a thin-film transistor (TFT) display, comprising:

a processor;

a memory coupled to the processor, wherein the memory includes instructions executable by the processor to:

set a voltage level for the TFT display during a first time period to a first voltage value;

determine a display run time of the TFT display during a second time period; and dynamically adjust the voltage level from the first voltage value to a second voltage value based on the display run time and a measured temperature of the TFT display.

10. The apparatus of claim 9, wherein the instructions to dynamically adjust the voltage level from the first voltage value to the second voltage value are further executable by the processor to:

identify the second voltage value by correlating the display run time of the TFT display with one of the voltage values in a lookup table stored in the memory.

11. The apparatus of claim 9, wherein the instructions to dynamically adjust the voltage level from the first voltage value to the second voltage value are further executable by the processor to:

determine an operation margin between a reference voltage ($V_{clamp}$) and a high level gate voltage (VGH) value; and maintain the operation margin from the first time period to the second time period by adjusting the voltage level.

12. The apparatus of claim 9, wherein the instructions to dynamically adjust the voltage level from the first voltage value to the second voltage value are further executable by the processor to:

adjust the voltage level in response to an increase of a positive bias temperature stress for the TFT display over the course of the TFT display lifetime.

13. The apparatus of claim 9, wherein the voltage level includes one or more of a low level gate voltage (VGL) value and a high level gate voltage (VGH) value of the TFT display.

14. The apparatus of claim 9, wherein the first voltage value is lower than the second voltage value.

15. A non-transitory computer-readable medium for controlling voltage bias of a thin-film transistor (TFT) display comprising instructions for:

setting a voltage level for the TFT display during a first time period to a first voltage value;

determining a display run time of the display during a second time period; and dynamically adjusting the voltage level from the first voltage value to a second voltage value based on the display run time and a measured temperature of the TFT display.

16. The non-transitory computer-readable medium of claim 15, wherein instructions for dynamically adjusting the voltage level from the first voltage value to the second voltage value, comprise instructions for:

identifying the second voltage value by correlating the display run time of the TFT display with the voltage level in a lookup table stored in a memory of the TFT display.

17. The non-transitory computer-readable medium of claim 15, wherein instructions for dynamically adjusting the voltage level from the first voltage value to the second voltage value, comprise instructions for:

determining an operation margin between a reference voltage ($V_{clamp}$) and a high level gate voltage (VGH) value; and maintaining the operation margin from the first time period to the second time period by adjusting the voltage level.

18. The non-transitory computer-readable medium of claim 15, wherein instructions for dynamically adjusting the voltage level from the first voltage value to the second voltage value comprise instructions for:

adjusting the voltage level in response to an increase of a positive bias temperature stress for the TFT display over the course of the TFT display lifetime.

19. The non-transitory computer-readable medium of claim 15, wherein the voltage level includes one or more of a low level gate voltage (VGL) value and a high level gate voltage (VGH) value of the TFT display.

* * * * *